US011350679B2

(12) United States Patent
Frankenbach et al.

(10) Patent No.: US 11,350,679 B2
(45) Date of Patent: Jun. 7, 2022

(54) BINDER

(71) Applicants: Gayle M. Frankenbach, Cincinnati, OH (US); Elliott Frankenbach Wilkinson, Cincinnati, OH (US)

(72) Inventors: Gayle M. Frankenbach, Cincinnati, OH (US); Elliott Frankenbach Wilkinson, Cincinnati, OH (US)

( * ) Notice: Subject to any disclaimer, the term of this patent is extended or adjusted under 35 U.S.C. 154(b) by 0 days.

(21) Appl. No.: 16/810,960

(22) Filed: Mar. 6, 2020

(65) Prior Publication Data

US 2020/0205485 A1 Jul. 2, 2020

Related U.S. Application Data

(63) Continuation of application No. PCT/US2018/049711, filed on Sep. 6, 2018.

(51) Int. Cl.

| | |
|---|---|
| ***A41C 3/00*** | (2006.01) |
| ***A41C 1/02*** | (2006.01) |
| ***D03D 15/56*** | (2021.01) |

(52) U.S. Cl.

CPC ..... *A41C 3/005* (2013.01); *A41C 1/02* (2013.01); *D03D 15/56* (2021.01); *A41B 2400/38* (2013.01)

(58) Field of Classification Search

CPC ..... A41C 1/02; A41C 3/005; A41B 2400/38
USPC ..... 2/69, 113
See application file for complete search history.

(56) References Cited

U.S. PATENT DOCUMENTS

| | | | | |
|---|---|---|---|---|
| 4,538,618 | A * | 9/1985 | Rosenberg | A61B 5/0059 600/407 |
| 4,960,112 | A | 10/1990 | Anderegg | |
| 5,060,648 | A | 10/1991 | Zarkesh | |
| 5,427,563 | A | 6/1995 | Manning | |
| 5,968,003 | A | 10/1999 | Sisson | |
| 5,980,359 | A | 11/1999 | Brown | |
| 7,867,058 | B2 | 1/2011 | Sweeney | |
| 8,172,639 | B2 | 5/2012 | Swendseid | |
| 8,465,341 | B2 | 6/2013 | Shashy | |
| 8,523,631 | B2 | 9/2013 | Smith | |
| 8,827,764 | B2 | 9/2014 | Caruso et al. | |
| 8,900,032 | B2 | 12/2014 | Punsal | |
| 9,480,287 | B2 | 11/2016 | Black et al. | |
| 9,480,288 | B2 | 11/2016 | Shashy | |
| 9,578,901 | B2 | 2/2017 | Randall et al. | |
| D780,403 | S | 3/2017 | Randal | |
| 9,955,741 | B2 * | 5/2018 | Roup | A41F 9/00 |
| 10,285,457 | B2 * | 5/2019 | Roup | A41D 1/14 |
| 2004/0002288 | A1 | 1/2004 | Bell et al. | |
| 2006/0179540 | A1 | 8/2006 | Rotter | |
| 2011/0275276 | A1 | 11/2011 | Shashy | |
| 2012/0071955 | A1 | 3/2012 | Yockel | |
| 2012/0144548 | A1 * | 6/2012 | Quaranta | A41B 17/00 2/69 |
| 2013/0115852 | A1 | 5/2013 | Blackwell | |

(Continued)

*Primary Examiner* — Gloria M Hale
(74) *Attorney, Agent, or Firm* — Stephen T. Murphy Law LLC; Peter D. Meyer; Stephen T. Murphy

(57) ABSTRACT

A binder for compressing the breasts of a wearer binder providing for a front panel formed by a single ply of a first woven textile and a rear panel connectively engaged to the front panel to form a garment. The rear panel is formed from a single ply of a second woven textile. The garment encircles the torso and overwraps the breasts of the wearer allowing the front panel to comfortably compress the breasts of the wearer.

20 Claims, 4 Drawing Sheets

(56) References Cited

U.S. PATENT DOCUMENTS

| | | | | |
|---|---|---|---|---|
| 2014/0317823 | A1* | 10/2014 | Hanson | A41D 15/005 2/69 |
| 2016/0374405 | A1* | 12/2016 | Washington | A41C 1/02 450/76 |
| 2020/0205485 | A1* | 7/2020 | Frankenbach | A41C 1/02 |

* cited by examiner

BINDER

FIELD OF THE INVENTION

The present disclosure relates to the flattening of breasts with clothing utilizing constrictive textiles. The present disclosure more particularly relates to a garment suitable for aesthetically providing a less-feminine appearance by the wearer that is more comfortable to wear.

BACKGROUND OF THE INVENTION

Breast binding is the act of flattening the breasts by wearing garments that use constrictive materials in the form of textiles. Whether for personal preferences, body dysphoria, or a sheer desire to fit men's clothing better, a binder is an excellent element of clothing that is suitable and useful for flattening the female chest and/or bust to create a more conventionally masculine silhouette.

There are many reasons people bind their breasts. For example, breast binding can provide accelerated recovery by reducing movement after an injury or surgery. Some women may use binders as alternatives to bras. Breast binding is common for cosplay, cross-play, and other forms of costuming. Other uses of breast binding, and the use of binders, can provide for the concealment of breasts or breast development, beauty and aesthetic reasons such as providing for a less-feminine appearance. The act of breast binding is common for transgender men, but is also done by androgynous, gender fluid people, as well as cross-dressers and performers. Further, breast binding may be used for the suppression of gender dysphoria (among many gender identities, especially trans men), for athletics, and possibly for lactation suppression.

Additionally, some adolescent girls may bind their breasts as they enter puberty. This may be done usually for reasons of modesty (they do not want others to see them), embarrassment (they do not want others to know they have started developing), or desire to be as they previously were (they do not want to have breasts yet). Additionally, men may also find cause to wear a binder garment when afflicted with gynecomastia to control appearance in place of surgery or during the wait before surgery.

Primarily, transgender men, or people with non-binary gender identities, as well as women who have developed larger breasts from hormone replacement therapy or breast augmentation surgery, may bind their breasts. Transgender men and people with other gender identities (typically male presenting) may bind their breasts as an alternative to or while waiting for a "top surgery" (mastectomy) to be recognized as masculine presenting. In any regard, a binder garment is intended to physically alter the bust in a manner that intends to not maintain the original or biologically presented bust or breast material.

Clothing that is used for binding may include textiles formed from materials that may include cloth strips, elastic or non-elastic bandages, purpose-built undergarments (often using Spandex or other synthetic fiber) and shirts layered from tight to loose.

Conversely, a bra or brassiere is a form-fitting undergarment designed to support a woman's breasts. Mass-produced bras are manufactured to fit a prototypical woman standing with both arms at her sides.

A bra is a complicated garment to make. A typical design has between 20 and 48 parts, including the band, hooks, cups, lining, and straps. The bra's main components are a chest band that wraps around the torso, two cups, and shoulder straps. The chest band is usually closed in the back by a hook and eye fastener, but may be fastened at the front. Sleep bras or athletic bras do not have fasteners and are pulled on over the head and breasts. The section between the cups is called a gore. The section under the armpit where the band joins the cups is called the "back wing".

Bra components, including the cup top and bottom (if seamed), the central, side and back panels, and straps, are cut to manufacturer's specifications. Many layers of fabric may be cut at the same time using computer-controlled lasers or bandsaw shearing devices. The pieces are assembled by piece workers using industrial sewing machines or automated machines. Coated metal hooks and eyes are sewn in by machine and heat processed or ironed into the back ends of the band and a tag or label is attached or printed onto the bra itself.

The chest band and cups of a typical brassiere, not the shoulder straps, are designed to support the weight of women's breasts. Strapless bras rely on an underwire and additional seaming and stiffening panels to support them. The shoulder straps of some sports bras cross over at the back to take the pressure off the shoulders when arms are raised. In short, a brassiere is intended to physically maintain the shape of the bust in a manner that intends to maintain, and not alter, the original or biologically presented bust or breast material.

Currently produced binders are significantly dissimilar from brassieres in both form and function. Further currently produced binders are fraught with problems. A typical binder is not only very tight but usually made of durable nylon and spandex—making them notoriously uncomfortable to wear. Binding, if done improperly, has the potential to hurt and even disfigure the wearer in both the short and long term. Using tape and certain types of bandages to bind the breasts (discussed supra) can quickly become a health hazard with the potential to cause scarring to skin, hurt mobility, and cause fluid build-up in lungs, or even broken ribs. The risks from binding can include back pain, skin issues, and restricted breathing. Pain and postural issues can result from binding. The only known way to avoid or minimize these serious health-related issues is to limit the number of hours per day that a binder is worn.

Methods to overcome these health-related issues have included, for example, wearing a sports bra or swimming suit top that is a few sizes too small that can be worn underneath normal clothes. Some binder wearers have reported that two normal sports bras can be worn, with the second one worn backwards. Sports or compression bras can also be used by firmly pushing them against the chest, but these methods are both unsafe and uncomfortable.

Other binder users have attempted binding with the use of an ace bandage or duct tape. However, these methods are also clearly dangerous and uncomfortable. These attempts may also cause cracked ribs, troubled breathing, and even suffocation if worn to sleep.

Further, excessive use of current binder garments, binding materials, and binding methods can lead to back pain and breathing trouble. Currently marketed products require the binder device and/or binding method to be as loose as is practical and not be worn for longer than 8 hours. Current binding products used for extended periods of time can lead to rashes or yeast infections under the breasts (where skin-to-skin contact occurs). Worse yet, unsafe binding products, materials, and methods may lead to permanent deformation of the breasts, scarring, and lung constriction. Long-term binding may adversely affect the outcome of a future mastectomy.

Clearly, there is a need for a binder that alleviates the above-mentioned health-related and comfort-related issues present in the currently available binder garments and binding methods. There is clearly a need for a garment that is intended to physically alter the bust in a manner that intends to not maintain the original or biologically presented bust or breast material. Such a garment will reduce or even eliminate the aforementioned, and observed, back pain, breathing issues, permanent breast deformation, scarring, rashes, and yeast infections. Such a binder garment will have minimal parts (compared to the 20-48 necessary to produce a brassiere) and will provide the wearer with the ability to provide the desired appearance during wear for longer periods of time than currently available products.

SUMMARY OF THE INVENTION

The present disclosure provides for a binder for compressing the breasts of a wearer. The wearer has a torso having a head, shoulders and arms associated thereto, a longitudinal axis, a Y-direction generally parallel to the longitudinal axis, a X-direction orthogonal and coplanar with the Y-direction, and a Z-direction generally orthogonal to both the X- and Y-directions and the longitudinal axis, the X- and Y-directions forming a plane generally parallel to the skin of a wearer. The binder comprises a front panel comprising a single ply of a first woven textile and a rear panel connectively engaged to the front panel to form a garment. The rear panel comprises a single ply of a second woven textile. The garment encircles the torso and overwraps the breasts of the wearer. The front panel compresses the breasts of the wearer in the Z-direction.

The present disclosure also provides for a binder for compressing the breasts of a wearer. The wearer having a torso having a head, shoulders and arms associated thereto, a longitudinal axis, a Y-direction generally parallel to the longitudinal axis, a X-direction orthogonal and coplanar with the Y-direction, and a Z-direction generally orthogonal to both the X- and Y-directions and the longitudinal axis, the X- and Y-directions forming a plane generally parallel to the skin of a wearer. The binder comprises a front panel comprising a single ply of a first woven textile, a rear panel connectively engaged to the front panel to form a garment and comprising a single ply of a second woven textile, first and second shoulder straps, and a closure device disposed intermediate the front panel and the rear panel. The garment encircles the torso and overwraps the breasts of the wearer. Each of the shoulder straps being connectively engaged at a first end to the front panel and at a second end to the rear panel and defining a region therebetween for insertion of the head. The closure device connectively engages an edge of the front panel and an edge of the rear panel. The front panel compresses the breasts of the wearer in the Z-direction.

DETAILED DESCRIPTION OF THE INVENTION

Figure 1:
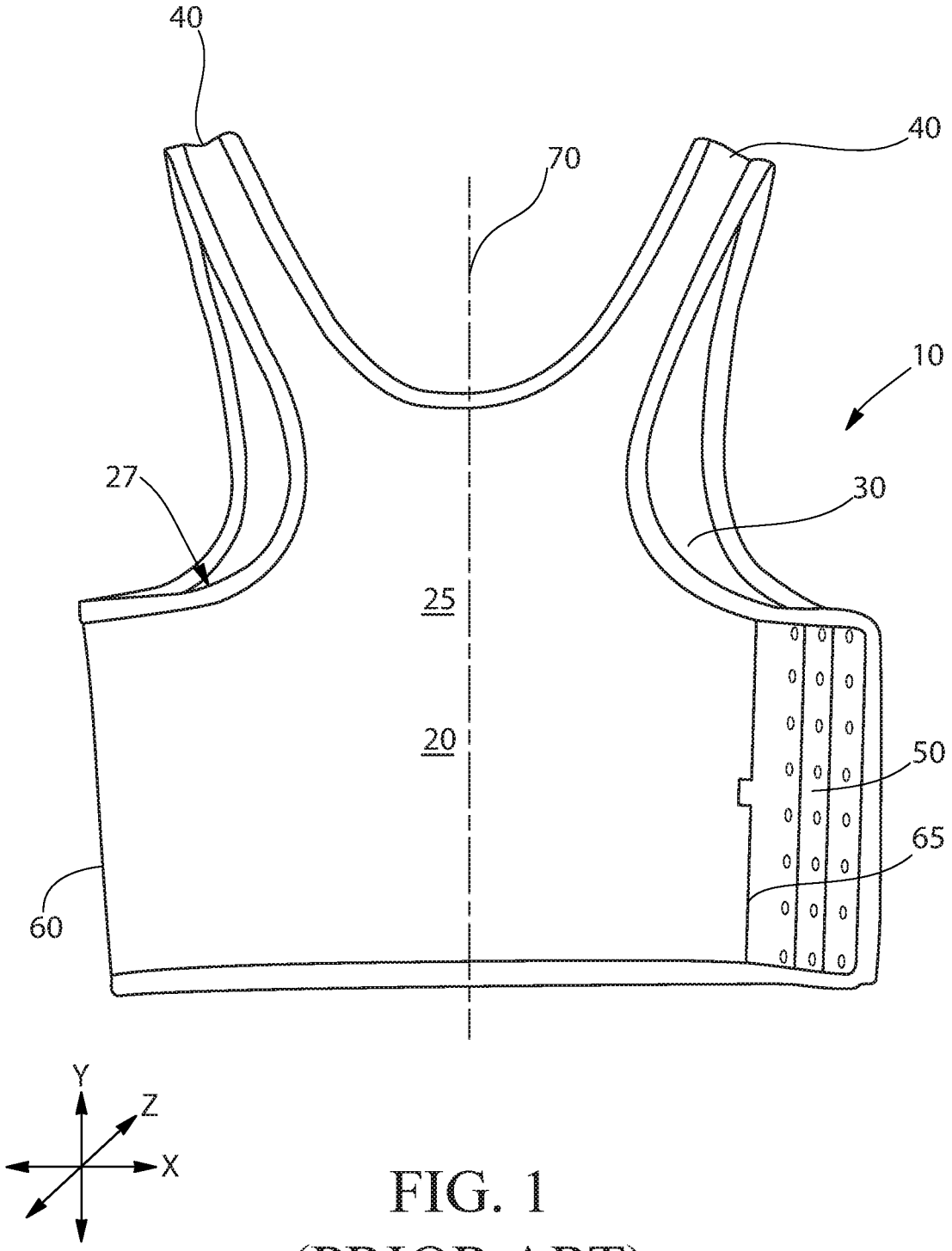
FIG. 1 (PRIOR ART)
FIG. 1 is a plan view of an exemplary prior art binder showing a front panel, back panel, shoulder straps, and an exemplary attachment device.
Figure 2:
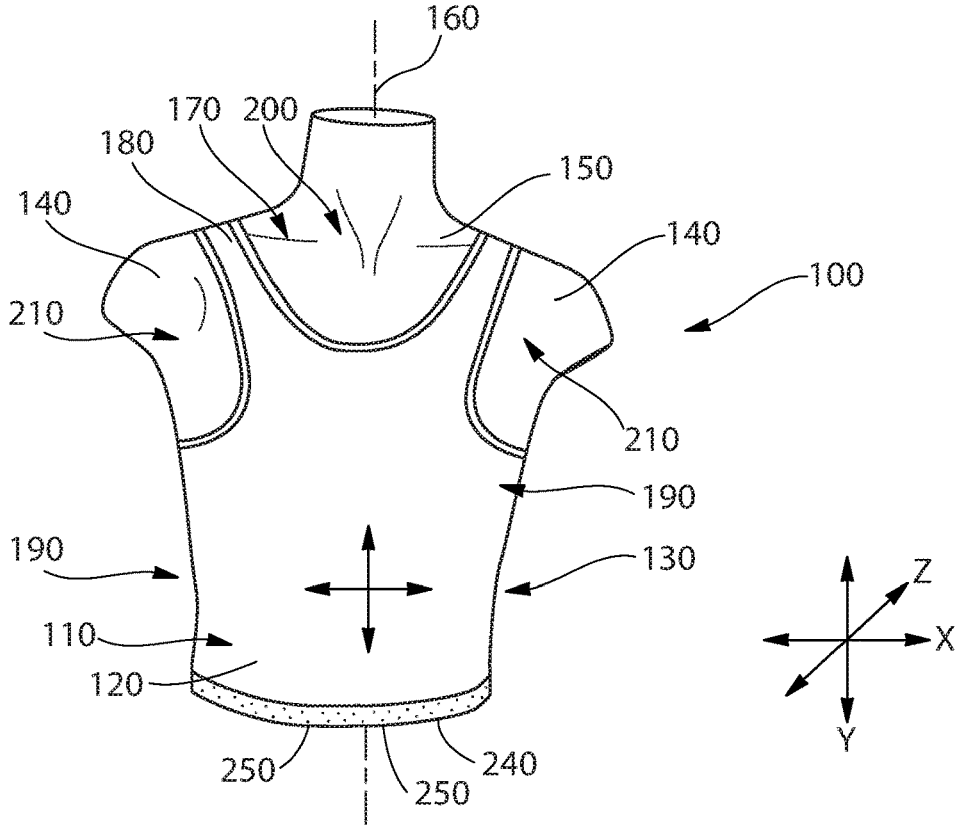
FIG. 2 is a perspective view of the front side of an exemplary binder consistent with the present disclosure.
Figure 3:
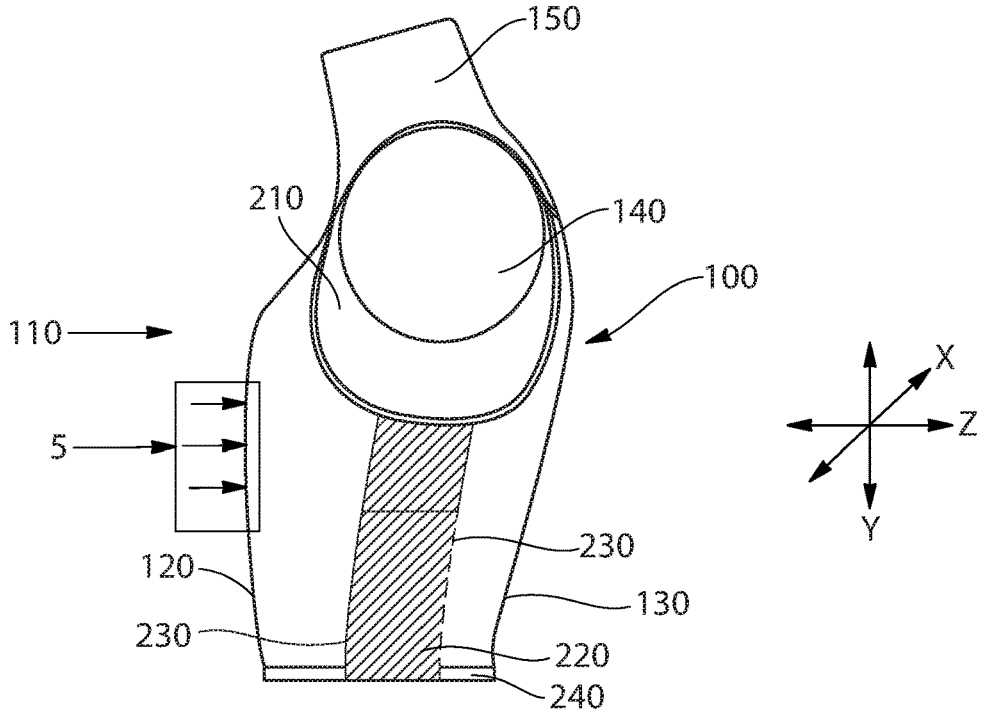
FIG. 3 is a is a perspective view of a side portion of the exemplary binder of FIG. 2 showing the attachment device consistent with the present disclosure.
Figure 4:
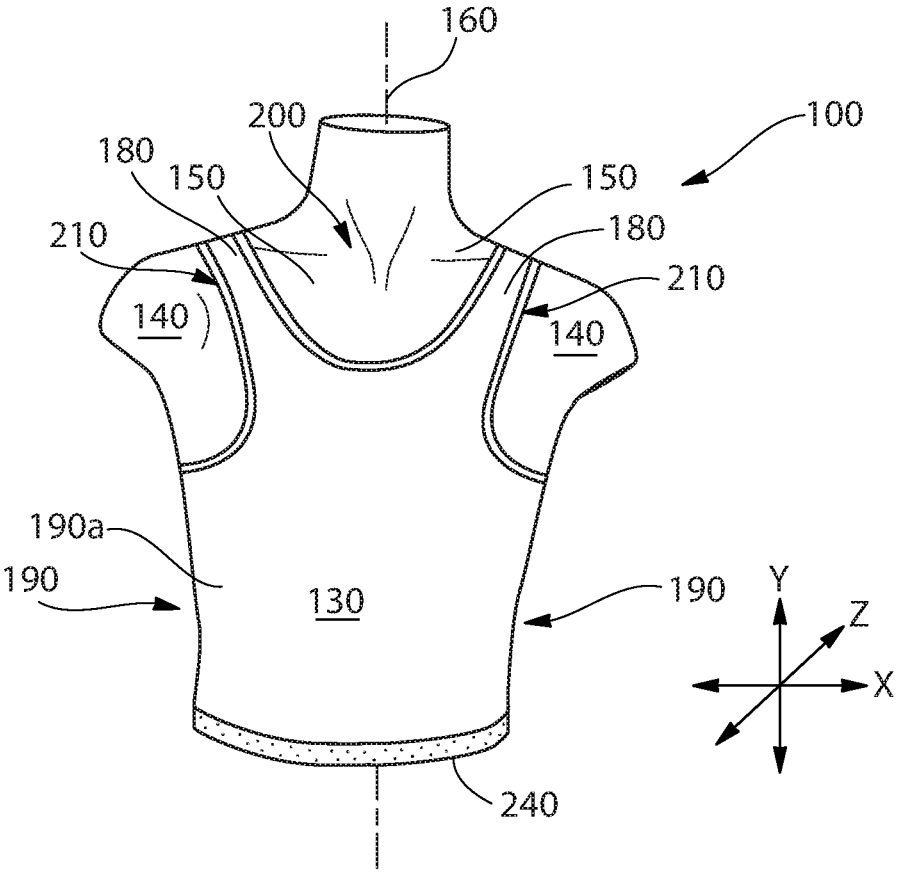
FIG. 4 is a is a perspective view of the back side of the exemplary binder of FIG. 2 consistent with the present disclosure.
Figure 5:
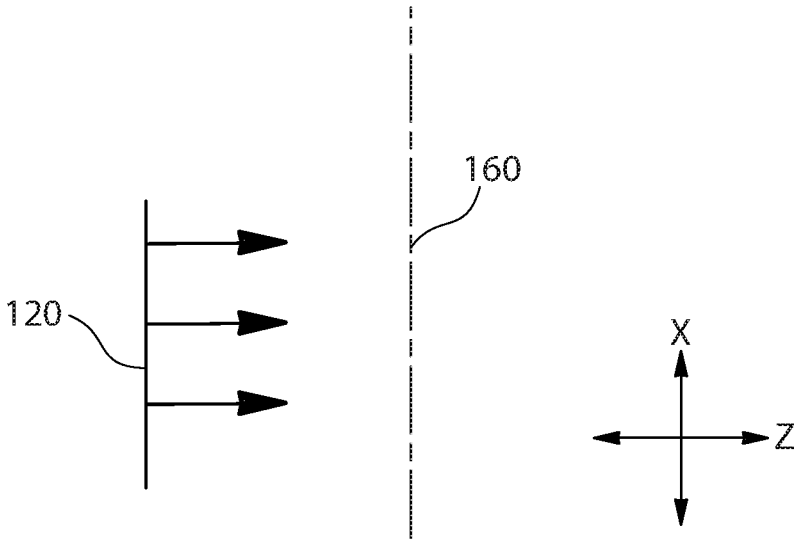
FIG. 5 is an expanded view of the area labelled 5 in FIG. 3.

Referring now to FIG. 1, an exemplary prior art binder 10 is shown having a front panel 20, a back panel 30, a pair of shoulder straps 40 and an attachment device 50. The front panel 20 of the prior art binder 10 is provided as two woven layers 25, 27 of disparate textile materials disposed in a face-to-face relationship. In other words, the front panel 20 of prior art binder 10 is provided as a two-ply woven, knitted, or cloth-like structure generally formed from two different textiles.

The outer woven ply 25 of the two-ply prior art structure used for forming the front panel 20 of prior art binder 10 is typically provided as a textile having a woven structure typical with outer-wear clothing. The purpose of the outer woven ply 25 of the two-ply structure used for forming the front panel 20 is to provide an authentic-look to the binder to obfuscate and/or disguise its function. Thus, the outer woven ply 25 of the two-ply structure used for forming the front panel 20 will generally have a texture and appearance that mimics everyday apparel.

The inner woven ply 27 of the two-ply structure used for forming the front panel 20 of prior art binder 10 is typically provided as a textile having a woven structure typically used with surgical wraps. Inner woven ply 27 of the two-ply structure used for forming the front panel 20 can be provided as a single horizontally and longitudinally extending elongated panel of non-stretchable (i.e., non-elongatable or elongation-resistant) cotton flannel material. This non-stretchable material is joined at the longitudinally-spaced lateral edges 60, 65 of the outer woven ply 25 of the two-ply structure used for forming the front panel 20. Alternatively, inner woven ply 27 of the two-ply structure used for forming the front panel 20 can be provided as a plurality of horizontally and longitudinally extending elongated interconnected panels of non-stretchable cotton flannel material ultimately joined at the longitudinally-spaced lateral edges 60, 65 of the outer woven ply 25 of the two-ply structure used for forming the front panel 20.

The purpose of the front panel 20 of the exemplary prior art binder 10 is to minimize any outward, Z-direction deflection of the material forming the front panel 20 caused by the breast material disposed thereunder. As shown in FIG. 1, and used consistently herein, the Y-direction is the direction generally parallel to the longitudinal axis 70 of the individual wearing or intending to wear an article of clothing. As shown in FIG. 1, and used consistently heretofore, the X-direction is the direction generally orthogonal and co-planar with the Y-direction. In dealing with an article of clothing and the textiles discussed herein, the X- and Y-directions generally comprise directions consistent with being parallel to the skin surface of the wearer. As would be understood by one of skill in the art, an article of clothing can be described as disposed coaxially about the surface of the wearer and the longitudinal axis 70 of the wearer. As shown in FIG. 1, and used consistently heretofore, the Z-direction is the direction generally orthogonal to both the X- and Y-directions and is generally perpendicular to the surface and the longitudinal axis 70 of the individual wearing or intending to wear an article of clothing.

As discussed supra, a binder or binding garment is intended to displace any breast material of the wearer or intended wearer in the Z-direction toward the surface or the longitudinal axis 70 of the individual wearing or intending to wear the binder by displacing the breast material of the wearer or intended wearer in the X- and Y-directions without regard to positional placement of any particular discrete portion of the breast. Thus, the textile forming the inner woven ply 27 of exemplary prior art binder 10 performs the intended Z-direction displacement toward the surface and longitudinal axis of the wearer by minimizing any X- and Y-direction displacement of the textile material forming the inner woven ply 27 of exemplary prior art binder 10. In clear contrast, a brassiere does not seek to displace any breast material of the wearer or intended wearer. A brassiere intends to maintain the positional placement of each discrete portion of the breast relative to each of the X-, Y-, and Z-directions relative to the wearer. A brassiere maintains such positional placement by providing sufficient support to the breast in order to maintain and not alter the original or biologically presented bust or breast material, as discussed supra.

In clear contrast to the garments discussed supra, an exemplary binder 100 worn by a user may include a single piece of fabric cut to provide a front panel 120 and at least a portion of the sides 190 and optional shoulder straps 180 of the binder 100 as shown in FIGS. 2-5. A cut-out top hole 200 in the cut fabric provides for placement of the finished bra over the head and over the shoulders 150 of the user. Cut-out arm holes 210 on both sides 190 for insertion of the arms 140 therethrough. Here, portions of the fabric disposed between the top hole 200 and each of the arm holes 210 can capably form the optional shoulder straps 180 that overlay the user's shoulders 150. In an alternative embodiment, one of skill in the art will recognize that shoulder straps 180 are not completely necessary. In such an embodiment, front panel 120 could be solely connectively engaged to rear panel 130 (also referred to herein as back panel 130) to form a de facto wrap that encircles the wearer or intended wearer's body without the need for shoulder straps 180.

The binder 100 may be donned by pulling it over the user's head through the top hole 200 and inserting the user's arms 140 through the arm holes 210. As would be understood by one of skill in the art, the binder 100 is disposed coaxially about the skin (surface) of the wearer or intended wearer and the longitudinal axis 160 of the wearer or intended wearer. In use, the binder effectively encircles the torso of the wearer or intended wearer and overlaps and/or overwraps the breasts of the wearer or intended wearer.

The front panel 120 is preferably formed from a first textile comprising a single ply of woven material that provides Z-direction compression of the breasts (i.e., toward the wearer or intended wearer's body in a direction generally toward (orthogonal to) the longitudinal axis 160) by providing adequate stretch of the textile material forming the front panel 120 in both the X- and Y-directions. The front panel 120 defines the area of the body of the wearer or intended wearer to be covered and can be formed from a single material to include all or, or at least a portion of the material forming the sides 190 and shoulder straps 180 of the binder 100. The material used to form the front panel 120 and/or back panel 130 of binder 100 can be preferably breathable, may be substantially inelastic, somewhat elastic, or completely elastic in an initial flat condition of the material prior to application of the elastic stitching for gathering of the portions forming binder 100.

A suitable material for forming front panel 120 preferably has equal stretch in both the X- and Y-directions. However, it may be preferable in some circumstances to provide a material for forming front panel 120 that has a preferentially greater stretch in either one of the X- and Y-directions as may be required to form the binder suitable for use with a wearer or intended wearer. By way of example, the front panel 120 of the garment forming binder 100 may have a lower stretch in the X-direction rather than the Y-direction in order to provide a better compression of the breast tissue disposed under front panel 120 in the Z-direction toward the skin of the wearer or intended wearer in a direction generally toward the longitudinal axis 160.

One material that was found particularly suitable as a textile for use in forming front panel 120 is Ponte de Roma double knit fabric (also known to those of skill in the art as Ponte di Roma or Ponte). Ponte de Roma fabric is can typically be formed from about 58% polyester and about 40% rayon, but other blends can be suitable for use to form a textile suitable for use with binder 100. One of skill in the art will appreciate that most Ponte textile knits may still contain some polyester, but usually in combination with any of rayon, nylon, or spandex materials. Polyester is strong and highly durable. Polyester resists shrinking, wrinkling, or stretching, and it dries fast. Nylon is durable and strong as well, but it's soft against the skin. Spandex is also durable and strong and has significant stretch. Spandex holds its shape and is commonly blended with other fibers in a Ponte knit. Lycra® is the brand name for Invista® (i.e., Du Pont®) version of spandex. Rayon is considered a natural fiber because it's made from wood cellulose. It's soft and comfortable, resists body heat retention, resists wrinkling, and dries fast. If a multi-textured material is to be used, it may be desirable to place the side with the least texture on a skin-facing side to facilitate a reduction in rubbing, fatigue and chafing which in turn can result in the development of edema.

Ponte de Roma refers to the way a fabric is constructed. Ponte de Roma is a weft-knitted, interlock-based, double-jersey fabric. Weft knitting refers to knit loops along the width of the fabric. Warp knitting, the opposite of weft knitting, refers to knit loops running vertically down the length of the fabric.

"Jersey" refers to a type of knit fabric that's constructed using knit stitches, or "plain" stitches, on the front and purl stitches on the back. The front side of a jersey knit is smooth and flat, with fine lines running across it, and the back is more textured.

"Interlock knits" are similar to jersey knits, except instead of using a purl stitch for the back, they are constructed using knit stitches on the front and back. In other words, both sides of an interlock knit look the same: smooth and flat. Because of this construction, interlock knits are more tightly woven than jersey knits and are therefore a bit less stretchy. "Double jersey" is a jersey material that is double-knit. Double knitting requires two needles and two sets of yarn, which results in a fabric with twice the thickness. When jersey is double-knit, the textured purl stitches are sandwiched together facing each other, with the knit stitches on the outsides of the fabric. So, much like interlock knits, double jersey knits are smooth and flat on both sides. A ponte knit is generally smooth and flat on both outwardly facing surfaces, and has fine lines running across on both faces. The back panel 130 is preferably and/or connectively engaged to the front panel 120 and at least one of the shoulder straps 180. Additionally, back panel 130 can be connectively engaged to at least one portion of the closure device 220 if/when the closure device is disposed between the front panel 120 and back panel 130 on a side 190 of the wearer or intended wearer. The back panel 130 is preferably formed from a second textile comprising a single ply of woven material. The second textile can preferably be a light, breathable fabric. The fabric may comprise neoprene, or an equivalent fabric with mechanical properties selected to have suitable elastic strength to provide compression to the breast tissue, at least partially or substantially immobilizing the breasts relative to the torso. Thus, the breasts and torso are contained to behave substantially, and be observed to resemble, male pectoral muscles. The first textile forming front panel 120 may be different from the second textile forming rear panel 130. However, it will be readily recognized that it may be advantageous in terms of cost and efficiency to provide the first textile forming front panel 120 to be the same as the second textile forming rear panel 130. It has been surprisingly found that it can be advantageous to provide either of the first textile forming front panel 120 or the second textile forming the rear panel 130 with a percent stretch value of at least about 5% in the Y-direction and a percent stretch value of at least about 5% in the X-direction as measured in accordance with the procedures detailed in ASTM 2594 and using 3-pound weight rather than the 5-pound weight indicated in ASTM 2594. In any regard, it is preferred that the first textile forming front panel 120 or the second textile forming the rear panel 130 have an X-direction stretch that is lower than the Y-direction stretch in order to apply appropriate pressure to the mammarial area of the user's chest. A preferred Ponte de Roma fabric suitable for forming front panel 120 can be provided with a basis weight ranging from about 100 g/m$^2$ to about 400 g/m$^2$. A preferred Ponte de Roma fabric may have a basis weight of about 220 g/m$^2$ or about 240 g/m$^2$. A preferred Ponte de Roma fabric can have a stretch as measured by ASTM D2594 of about 12.5% (length in the Y-direction (weft)) and about 6.25% (width in the X-direction (warp)). A preferred Ponte de Roma fabric can have a breathability as measured by ASTM D737 of greater than about 923 CFM/ft$^2$. Identified fabric parameters and properties for ten different and exemplary knitted fabrics provided for use as front panel 120 and rear panel 130 are presented in Table 1 infra.

TABLE 1

Fabric Parameters and Properties for Ten Different Knitted Fabrics

| | Fiber type | | | | | | | | | |
|---|---|---|---|---|---|---|---|---|---|---|
| | Polyester | Polyester/ Cotton | Cotton/ Spandex | Polyester | Polyester/ Spandex | Cotton | Cotton/ Nylon | Cotton | Cotton | Polyester/ Rayon/ Spandex |
| **Fabric Parameters** | | | | | | | | | | |
| Course/ centimeters (cpcm) | 102 | 122 | 201 | 206 | 84 | 112 | 165 | 107 | 89 | 132 |
| Wales/ centimeters (wpcm) | 114 | 71 | 102 | 122 | 132 | 91 | 107 | 79 | 74 | 226 |
| Course/wale density ratio | 0.89 | 1.71 | 1.99 | 1.68 | 0.63 | 1.22 | 1.55 | 1.34 | 1.19 | 1.56 |
| Fabric weight (g/m$^2$) | 130 | 254 | 265 | 149 | 272 | 185 | 293 | 188 | 154 | 370 |
| Fabric thickness (mm) | 0.43 | 0.91 | 0.94 | 0.59 | 0.62 | 0.72 | 0.82 | 0.73 | 0.75 | 0.83 |
| **Fabric Properties** | | | | | | | | | | |
| Air permeability (l/min) | 105.6 | 45.9 | 6.8 | 90.3 | 48.3 | 26.6 | 4.4 | 20.7 | 78.5 | 11.6 |
| AOTI | 708.93 | 2146.15 | 1714.04 | 1265.35 | 1028.07 | 1510.81 | 1424.61 | 1557.50 | 1575.92 | 1391.69 |
| Water vapor permeability | 120 | 95.17 | 100 | 103.55 | 97.87 | 89.36 | 94.16 | 94.16 | 97.08 | 95 |

Where:

AOTI: Accumulative One-Way Transport Index

OMMC: Overall Moisture Management Capacity

Air permeability was measured according to ASTM D737-04/2008 using a MESDAN Air-Tronic Air Permeability tester. The measurement details are: test area of 10 cm$^2$, a test pressure of 100 Pa and an air volume of 10 liters. Results are reported in units of liters per minute (1/min).

Water Vapor Permeability was measured according to standard test method BS 7209 (British Standard specification for water vapor permeable apparel fabrics) using an SDL Atlas Water Vapor Permeability Tester. In short, the standard test method involves the determination of weight loss with the evaporation time of water contained in a cup. The test method compares the rate of water mass transfer through fabric from eight cups, two of them covered with reference fabric and the other six with test samples. The water vapor permeability index calculated by expressing water vapor permeability (WVP) of the fabric sample as a percentage of the WVP of the reference.

$$(WVP) = \frac{24M}{At}$$

where:

M=is the loss in mass (g);

t=time interval (h); and,

A=area of exposed sample equal to the internal area of the test cup ($m^2$).

Water vapor permeability index (L) can be calculated by:

$$L = \frac{WVP(\text{test})}{WVP(\text{reference})} \times 100$$

One of skill in the art would likely understand that it is desirable to provide a material for front panel 120 and/or rear panel 130 having a water vapor permeability of greater than about 50, or greater than about 80, or greater than about 90, or greater than about 95, or greater than about 100. Further, one of skill in the art would likely understand that it is desirable to provide a material for front panel 120 and/or rear panel 130 that has an air permeability of greater than about 4 or greater than about 6, or greater than about 10, or greater than about 20, or greater than about 50. Additionally, several materials that could be suitable candidates for front panel 120 and/or rear panel 130 were tested according to ASTM D2594 (Standard Test Method for Stretch Properties of Knitted Fabrics Having Low Power) and the results of this testing are provided in Tables 2-4 infra.

TABLE 2

Fabric % Growth Measured After 60 s Recovery Time

| Sample Number/Fabric | % Growth Average 3 Runs (Standard Deviation) Wales (X-direction) | Courses (Y-direction) |
|---|---|---|
| 1A/Ponte de Roma | 4.2 (0.5) | 5.5 (0.0) |
| 2A/Stretch Mesh | 3.9 (0.0) | 5.0 (0.5) |
| 3A/Grey Stretch Fabric | 2.1 (0.5) | 4.2 (0.5 |
| 1B/White Gabardine | * | * |
| 2B/Duck Cloth | * | * |

TABLE 3

Fabric % Growth Measured After 1 hr. Recovery Time

| Sample Number/Fabric | % Growth Average 3 Runs (Standard Deviation) Wales (X-direction) | Courses (Y-direction) |
|---|---|---|
| 1A/Ponte de Roma | 1.6 (0.0) | 3.1 (0.0) |
| 2A/Stretch Mesh | 1.6 (0.0) | 2.6 (0.4) |
| 3A/Grey Stretch Fabric | 1.3 (0.5) | 3.4 (0.5) |
| 1B/White Gabardine | * | * |
| 2B/Duck Cloth | * | * |

TABLE 4

Fabric % Stretch After 5 Cycles with 10 lb Load.

| Sample Number/Fabric | % Growth Average 2 Runs (Standard Deviation) Wales (X-direction) | Courses (Y-direction) |
|---|---|---|
| 1A/Ponte de Roma | 18.5 (0.6) | 42.9 (0.6) |
| 2A/Stretch Mesh | 61.4 (1.1) | 180.7 (0.6) |
| 3A/Grey Stretch Fabric | 79.1 (1.6) | 111.0 (0.0) |
| 1B/White Gabardine | * | * |
| 2B/Duck Cloth | * | * |

Where:

Sample 1A—Polyester-Rayon-Spandex blend ponte de roma

Sample 2A—A Nylon-Spandex blend stretch mesh

Sample 3A—A Nylon-Spandex blend stretch fabric

Sample 1B—100% polyester gabardine

Sample 2B—100% cotton duck canvas fabric

It should be noted that one of skill in the art will understand that the white gabardine sample (1B) and the duck cloth sample (2B) cannot be measured by ASTM D2594 because these fabrics do not have a cognizable stretch.

Thus, it would be suitable for one of skill in the art to use a material similar to Sample 1A (Polyester/Rayon/Spandex blend ponte de roma) for forming front panel 120. Furthermore, one of skill in the art would find it suitable to use a material similar to Sample 2A (Nylon/Spandex blend stretch mesh) or Sample 3A (Nylon/Spandex blend stretch fabric) for forming back panel 130. In this regard, it is preferable to provide front panel 120 with a material having an X-direction stretch of less than about 10 and a Y-direction stretch of less than about 10. It is also preferable to provide back panel 130 with a material having an X-direction stretch of less than about 10 and a Y-direction stretch of less than about 20.

When the binder 100 is applied to the torso of the wearer or intended wearer, the elasticized body portion formed by front panel 120 and rear panel 130 is wrapped around the chest of the wearer or intended wearer and secured by means of the closure device 220. The opposing ends of the elasticized main body portion can form a closure area located at any point disposed about the torso of the user. The closure area can be either at the front or adjacent one side of the user's body, which can provide a more convenient access to the closure by the wearer or intended wearer. However, the binder 100 can also be closed at the back of the wearer's body as will be discussed infra. Further, the back panel 130 may further be fixably attached, (e.g., sewn) to front panel 120 fabric thereby forming and surrounding the top hole 200 to form a seam, thus completing a halter structure that provides support and compressive stability both Y-direction (i.e., vertically) by elastic stress over the shoulders and the X-direction (i.e., horizontally) by elastic stress from the wearer or intended wearer's front, around the sides 190 under the arms 140 to the user's back. The locally and resiliently deformable fabric used to make the back panel 130 may be over-sheathed, sewn, bonded or laminated on an inner surface facing the user's body, exterior surface, or both, with a "breathable" fabric to wick moisture (such as perspiration) during physical activity. The breathable fabric may or may not be elastic and may or may not further contribute to compression stabilization of the breasts.

A function of the over-sheath fabric includes providing skin contact comfort and moisture breathability (wicking). Exemplary inner and outer oversheath material may include nylon, Lycra®, spandex, cotton, blends of these materials, or the like, which have suitable stretch and wicking properties. As used herein, a breathable material permits passage of air through it, such as from the surrounding atmosphere to the skin of the wearer or intended wearer. As used herein, a substantially inelastic material is one that does not stretch a significant amount beyond its normal (non-elasticized) size. That is, although there may be some small amount of stretch in the inelastic material prior to it being elasticized, preferably it does not stretch significantly, particularly in the direction parallel to the longitudinal axis 160 of the wearer or intended wearer (i.e., Y-direction). Such substantially inelastic material is used in preferred embodiments of the binder 100.

The fabric forming the rear panel 130 may comprise fabrics having mechanical properties selected to have suitable elastic strength to provide compressive support to breast tissue, at least partially or substantially immobilizing the breasts relative to the torso during physical movement. Thus, the breasts and torso are contained to behave substantially as a single structure during physical motion to reduce strain and possible trauma to breast tissue. A preferred textile for forming the rear panel 130 can be a Spandex/nylon blend mesh fabric. Such a blend can exhibit a 4-way stretch exhibiting about a 70% size increase when stretched in the X-direction and about a 60% size increase when stretched in the Y-direction. A spandex/nylon blend can provide a lightweight knit and be incredibly sheer. An exemplary spandex/nylon blend suitable for use as a textile for forming rear panel 130 will be 82% nylon and 18% spandex. However, one of skill in the art will likely understand that other blends can be provided that are equally suitable for forming a textile that is capable of delivering the structure and benefits relative to rear panel 130 articulated herein. It may be desirable for the rear panel 130 to be sheer against the skin. Therefore, the selection of material that can provide such a sheer look against human skin can also be preferred.

A preferred spandex mesh fabric can be provided with a basis weight ranging from about 10 $g/m^2$ to about 200 $g/m^2$. A preferred spandex mesh fabric may have a basis weight of about 69 $g/m^2$.

A preferred spandex mesh fabric can have a stretch as measured by ASTM D2594 of about 118% or about 94% (length in the Y-direction (weft) and about 30% or about 25% (width in the X-direction (warp)). A preferred spandex mesh fabric can have a breathability as measured by ASTM D737 of greater than 923 $CFM/ft^2$. In any regard, it is preferable to provide a material that provides the lowest stretch (as measured according to ASTM D2594) in the X-direction in order to provide the application of the greatest compression to the chest of the wearer or intended wearer. In any regard, it should be understood that the binder 100 may be cut from a single piece of fabric with the binder 100 formed into a wearable garment by attaching the shoulder straps 180 to both the front panel 120 at a first (proximal) end and rear panel 130 at a second (distal) end.

Alternatively, the binder 100 may be made from a plurality of separate pieces sewn together. In the alternative construction, it will be understood that the amount of compression applied will change based on the location of any seams disposed between adjoining parts of the binder 100 and whether the seams are non-stretchable or stretchable. Therefore, custom configurations with different compression forces exerted by front panel 120 toward the body of the wearer or intended wearer can be provided by adding seams at selected locations on any combination of the front panel 120, rear panel 130, and/or shoulder strap 180. Further, placement of the closure device 220 can also influence the compression of the binder 100 upon the wearer or intended wearer. Further, all cut edges and seams of the fabric of the binder 100 may be finished for cosmetic appearance and to prevent unraveling and/or fraying at the fabric edges. For example, it may be possible to influence the overall compression delivered by the binder 100 upon the breasts of the wearer by placing the closure device 220 within the front panel 120 by connectively engaging first and second portions thereof, the rear panel 130 by connectively engaging first and second portions thereof, or within a side 190 of binder 100 by connectively engaging the front panel 120 and rear panel 130 thereof. In other words, the compressive force delivered by the binder 100 can be adjusted as required by placement of the closure device 220 by wearing the binder 100 with the closure device 220 with a non-stretchable seam in either of the front panel 120 or the rear panel 130.

As an example, when the binder 100 is worn with the closure device 220 in front (where the closure device 220 would be a non-stretchable seam), the compression would be greater whereas wearing the binder 100 with the closure device 220 in the back would result in a more relaxed compression in the front. A closure device 220 may be optionally included in the binder 100. For example, the back panel 130 may be closed (e.g., attached) to the front panel 120 by bringing together and securing the respective edges 230 of the back panel 130 and the front panel 120 extending from each side by a closure device (e.g., a securement device). In a preferred embodiment, closure device 220 is preferably vertically integrated relative to binder 100 in order to more easily and effectively facilitate the connection of opposed edges of the respective portions of the binder 100 attached to opposed ends of closure device 220. A plurality of fastening devices integral with closure device 220 can easily provide for the releasable and adjustable opening and closure of closure device 220. As would be understood by one of skill in the art, a suitable closure device 220 could be provided in the form of a zipper, a slider, a plurality of VELCRO™ hook and loop fasteners, conventional metallic hook and loop fasteners, combinations thereof, and the like.

In a preferred embodiment, the closure device 220 preferably includes a hook and loop fastener. This fastener permits a range of adjustability to provide a desired degree of breast control and comfort. Such a hook and loop fastener is attached at the binder 100 ends of the main body portion disposed between front panel 120 and rear panel 130 so that one part of the closure device 220 (e.g., the hook portion) is attached at one edge 230 disposed upon front panel 120 on the side 190 and the other part (e.g., the loop portion) is attached at the other edge 230 to the other edge disposed upon rear panel 130. When the binder 100 is applied to the torso, the front panel 120 and rear panel 130 are both pulled and stretched about the torso so that one edge 230 overlaps (i.e., vertically cooperates) the other edge 230 allowing the hook and loop portions to overlap and engage each other. The degree of overlap is preferably adjustable by the wearer or intended wearer to achieve the desired degree of control and comfort. At least a part of the material used to form front panel 120 and rear panel 130 can be stretchable about the body of the wearer or intended wearer.

Further, the material forming front panel 120 and rear panel 130 may be provided with elastic gatherings. In an open position of the closure device 220, donning and removing the binder 100 is made easier. In an embodiment using a zipper as a closure device 220, an extension (e.g., string, strap, or the like) may be added to the zipper slider to make an opening and closing manipulation of the zipper and slider easier for the user. Closure of the zipper may be achieved by movement of the slider from top to bottom or, alternatively, from bottom to top. Closure by top to bottom motion of the slider enables a smooth, consistent tension and compression across the entire breast region to compress the breast against the torso. One of skill in the art will appreciate that, the closure device 220 may be placed elsewhere, for example, at one or more of the sides 190, the front 110, or the like. Alternatively, the binder 100 may not incorporate a closure device 220 (e.g., no zipper/slider, etc.), and is donned without additional means for closure. The rear panel 130 may further be sewn to form and surround the top hole 200 to form a seam and provide for a halter structure that provides support and compressive stability both vertically by elastic stress over the shoulders 150, and horizontally, by elastic stress from the user's front 110 around the sides 190 under the arms 140 to the wearer or intended wearer's back. The attachments of the front panel 120, rear panel 130, shoulder straps 180, and/or closure device 220 can be made by gluing, sewing, integral knitting, ultrasonic welding, ultrasonic sewing, combinations thereof, and the like.

Referring again to FIGS. 2-3, at least one torso-surrounding band 240 can be disposed at least partially or at least completely coaxially about the longitudinal axis 160 may be provided in conforming and attaching engagement with binder 100. It is believed that the at least one torso-surround band 240 be at least coextensive with the totality of front panel 120. One of skill in the art will appreciate that the at least one torso-surrounding band 240 can prevent "bunching" or "curling" of the binder 100 into the mammarial area of the user. In other words, the torso-surrounding band 240 holds the region of the binder 100 that would be disposed proximate to the navel and/or mammarial area of the wearer in place. Such a torso-surrounding band could be formed into the end of the binder 100 distal from the shoulder 150 so that the torso-surrounding band 240 is finally disposed and positioned underneath the breasts of the user when the binder 240 is worn.

The torso-surrounding band 240 can be formed by the material used to form the front panel 120 and/or rear panel 130. For example, the torso-surrounding band 240 could be sewn into the material used to form the front panel 120 and/or rear panel 130 by stitching. In this manner, the entirety of the binder 100 could be produced and maintained as a single layer (i.e., ply) of textile. Alternatively, torso-surrounding band 240 can be formed by "folding over" end of the material distal from the shoulder 150 and forming the front panel 120 and/or rear panel 140 and stitching the two folded-over pieces together. This manner of forming the torso-surrounding band 240 can result in a structurally more resilient construction that can be used to further resist the natural "bunching" that occurs when textile used to form clothing to be worn about a wearer moves in concert with the wearer.

Yet further still, a material different from that used to form any of the front panel 120 and rear panel 140 can be sewn or otherwise attached to the material used to form any of the front panel 120 and rear panel 140 at the end distal from the shoulders 150. Such a material can be a high compression elastic material that provides a necessary degree of stiffness (i.e., limited stretch in width) to the bottom portion of the binder 100 distal from the shoulders 150 and proximate to the wearer's navel. An exemplary elastic material can be curl and/or roll resistant. To further enhance the coefficient of friction against the body of the wearer (in an effort to reduce "bunching"), such an elastic material can be provided with a plurality of rugosities 250 upon a skin-facing surface thereof. Such rugosities could be, for example, a plurality of silicone dots, a collectively elongate series of silicone dots, or even a linear or curvilinear pattern of silicone adhered to the surface of the material forming the torso-surrounding band 240 that would ultimately contact the skin of the wearer or intended wearer.

Suitable materials could be provided as materials suitable for use as active sportswear that prevent "riding up". A woman's breasts do not move up and down together, but rather separately, in what is called a "butterfly" or figure-eight motion when they are moving. This movement of the breasts is very painful and possibly damaging to the supportive breast tissue. The combination of encapsulation and compression of the breasts by the front panel 120 can counteract this butterfly motion by providing maximum support by the binder 100 and can thereby reduce impact on the breasts when the wearer or intended wearer is active. Encapsulation and compression can be generally accomplished with a fabric that is itself provided to control breast movement by flattening the breast tissue against the chest of the wearer. Binder 100 compresses the breasts toward the wearer or intended wearer's torso. Further, the front panel 120 and rear panel 130 move and flex with the wearer or intended wearer rather than move independently of her. In any regard, compression fabric or fabrics tending to have compressive characteristics may also be used for the front panel 120 and rear panel 130 so that the entire binder 100 has a slightly firmer fit.

The outer front panel 120 and rear panel 130 together provide the compression required for deforming the wearer's or intended wearer's breasts during use. Uniting the front panel 120 and rear panel 130 together with the closure device 220 can uniquely provide the needed compression to prevent breast movement and restrict breast deformation in the Z-direction. The placement of closure device on the side 190 disposed intermediate front panel 120 and rear panel 130 can ensure that the fabric of the front panel 120 is pulled tightly enough to provide such compression. This makes putting the binder 100 on very easy. Further, another benefit is that a wearer or intended wearer can open or close closure device 220 after use to release the compression and breathe easier.

Figure 6:
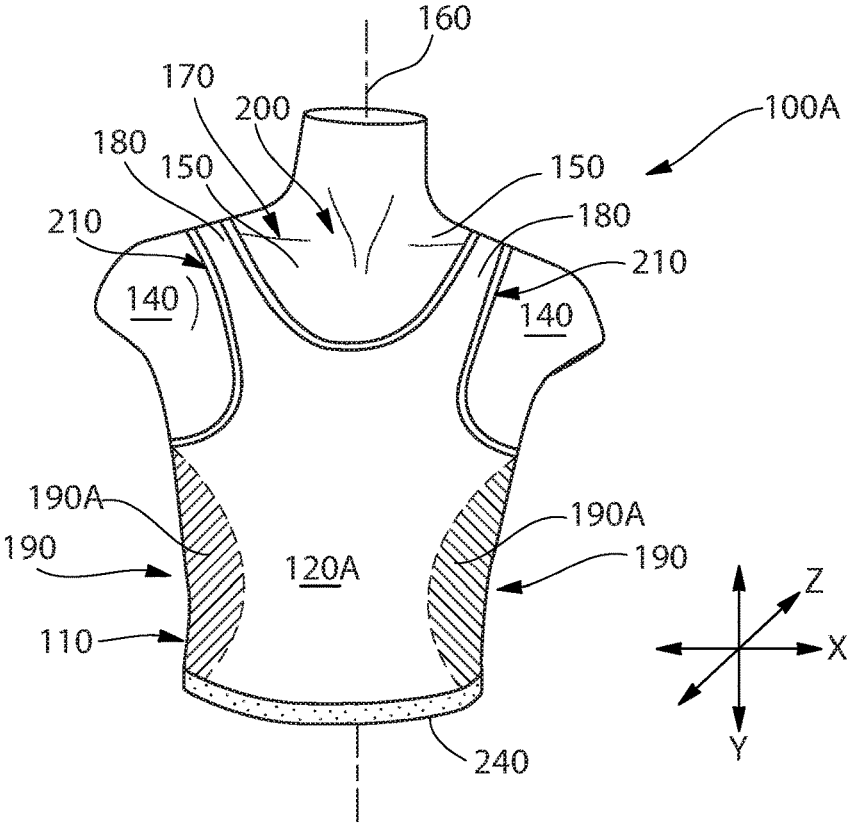
FIG. 6 is a perspective view of the front side of another exemplary binder consistent with the present disclosure; and, FIG. 7 is a is a perspective view of a side portion of the exemplary binder of FIG. 6.
Figure 7:
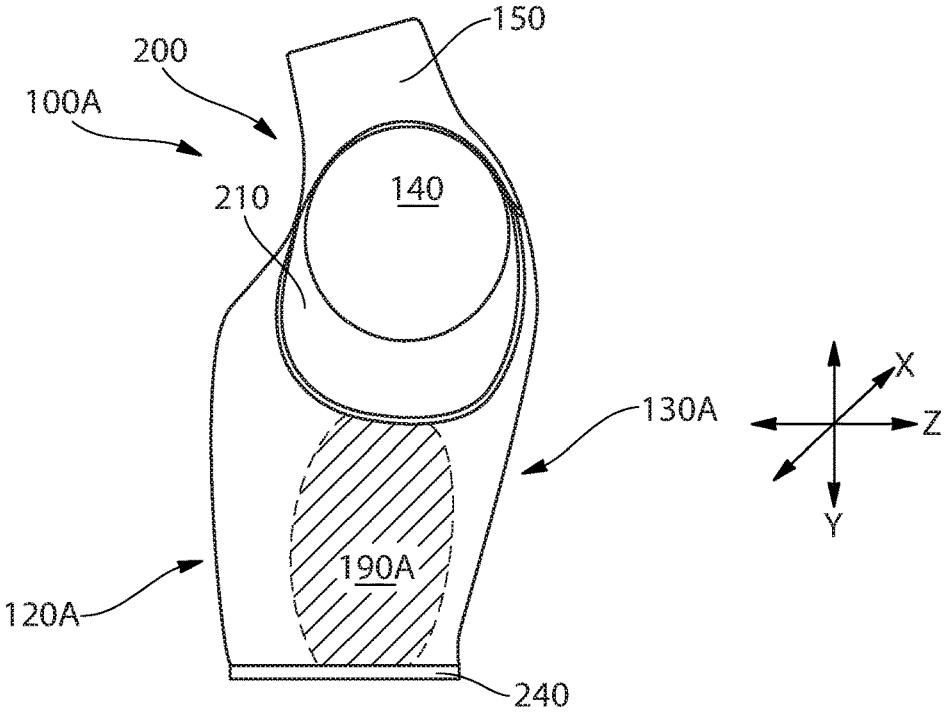

In the alternative embodiment shown in FIGS. 6 and 7, the binder 100A worn by a user may include a single piece of fabric cut to provide a front panel 120A and optional shoulder straps 180. A cut-out top hole 200 in the cut fabric provides for placement of the finished binder 100A over the head and over the shoulders 150 of the user. Cut-out arm holes 210 on both sides 190 for insertion of the arms 140 therethrough. Here, portions of the fabric disposed between the top hole 200 and each of the arm holes 210 can capably form the optional shoulder straps 180 that overlay the user's shoulders 150. A first and/or a second side panel 190A can be connectively engaged to, and disposed between, front panel 120A and rear panel 130A on either side 190 of the wearer or intended wearer. One of skill in the art will recognize that shoulder straps 180 are not completely necessary in that front panel 120A can only be connectively engaged to each side panel 190A which are both connectively engaged to rear panel 130A to form a de facto wrap that encircles the wearer or intended wearer's body without the need for shoulder straps 180.

The front panel 120A is preferably formed from a first textile comprising a single ply of woven material that provides Z-direction compression of the breasts (i.e., toward the wearer or intended wearer's body in a direction generally toward (orthogonal to) the longitudinal axis 160) by providing adequate stretch of the textile material forming the front panel 120A in both the X- and Y-directions. Each side panel 190A can each be attached to the front panel 120A to place the respective side panel 190A proximate to the side 190 of the wearer or intended wearer. Each side panel 190A can be preferably formed from a second textile comprising a single ply of woven material. The back panel 130A is preferably and/or connectively engaged to each of the opposed side panels 190A and at least one of the shoulder straps 180. The back panel 130A is preferably formed from a third textile comprising a single ply of woven material.

The binder 100 and/or binder 100A according to the present disclosure also could be incorporated into many different types of clothing, including but not limited to everyday (i.e., non-sports) wear, camisole tops, scuba gear, or any other type of clothing. Any portion of the front panel 120/120A, rear panel 130/130A, any provided side panels 190A, and or shoulder straps 180 could be connected to the outer layer of the clothing in question. Additional or alternative connection points for the binder 100 to the outer garment include, but are not limited to: along the underarms, at the straps, or at the straps and underarms.

Any dimensions and/or values disclosed herein are not to be understood as being strictly limited to the exact numerical values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A binder (100) for compressing breasts of a wearer, said wearer having a torso having a head, spine, chest, shoulders, and arms associated thereto, said wearer also having a longitudinal axis (160) generally parallel to said spine of said wearer, a Y-direction generally parallel to the longitudinal axis (160), a X-direction orthogonal and coplanar with said Y-direction, and a Z-direction generally orthogonal to both said X- and Y-directions and said longitudinal axis (160), said X- and Y-directions configured to form a plane generally parallel to said spine and a surface of said chest of said wearer, said breasts extending from said surface of said chest of said wearer in said Z-direction, said binder (100) comprising:

a. a front panel (120) comprising a single ply of a first woven textile;

b. a rear panel (130) connectively engaged to said front panel (120) to form a garment, said rear panel (130) comprising a single ply of a second woven textile, said garment encircling said torso and overwrapping said breasts of said wearer;

c. wherein said front panel (120) is configured to compress said breasts of said wearer toward said surface of said chest of said wearer in said Z-direction.

2. The binder (100) of claim 1 further comprising at least one shoulder strap (180) said shoulder strap (180) being connectively engaged at a first end to said front panel (120) and at a second end to said rear panel (130).

3. The binder (100) of claim 2 further comprising a second shoulder strap (180) connectively engaged at a first end to said front panel (120) and at a second end to said rear panel (130), said shoulder straps (180) defining a region therebetween for insertion of said head.

4. The binder (100) of claim 1 further comprising a closure device (220) disposed intermediate said front panel (120) and said rear panel (130), wherein said closure device (220) connectively engages an edge (230) of said front panel (120) and an edge (230) of said rear panel (130).

5. The binder of claim 1 further comprising a closure device (220) disposed intermediate said front panel (120) wherein said closure device (220) connectively engages a first portion of said woven textile forming said front panel (120) and a second portion of said woven textile forming said front panel (120).

6. The binder of claim 1 further comprising a closure device (220) disposed intermediate said rear panel (130) wherein said closure device (220) connectively engages a first portion of said woven textile forming said rear panel (130) and a second portion of said woven textile forming said rear panel (130).

7. The binder of claim 1 wherein said single ply of a woven textile forming said front panel (120) stretches in at least one of said X- and Y-directions, said stretching in at least one of said X- and Y-directions being configured to compress said breasts of said wearer toward said surface of said chest of said wearer in said Z-direction.

8. The binder of claim 1 wherein said woven textile forming said front panel (120) has a breathability of greater than about 923 CFM/ft$^2$ as measured by ASTM D737.

9. The binder of claim 1 wherein said first woven textile forming said front panel (120) is different from said second woven textile forming said rear panel (130).

10. The binder of claim 1 wherein said first woven textile forming said front panel (120) is the same as said second woven textile forming said rear panel (130).

11. The binder of claim 1 wherein said first textile forming said front panel (120) has a percent stretch value of at least about 5% in said Y-direction and a percent stretch value of at least about 5% in said X-direction as measured in accordance with ASTM 2594.

12. The binder of claim 1 wherein said second textile forming said rear panel (130) has a percent stretch value of at least about 45% in said Y-direction and a percent stretch value of at least about 5% in said X-direction as measured in accordance with ASTM 2594.

13. The binder of claim 12 wherein said second textile forming said rear panel (130) is a mesh fabric.

14. The binder of claim 13 wherein said second textile forming said rear panel (130) is a spandex/nylon blend.

15. The binder of claim 1 wherein said front panel (120) further comprises a second ply of said first woven textile bonded to said first ply of said first woven textile.

16. A binder (100) for compressing breasts of a wearer, said wearer having a torso having a head, spine, chest, shoulders and arms associated thereto, said wearer also having a longitudinal axis (160) generally parallel to said spine of said wearer, a Y-direction generally parallel to the longitudinal axis (160), a X-direction orthogonal and coplanar with said Y-direction, and a Z-direction generally orthogonal to both said X- and Y-directions and said longitudinal axis (160), said X- and Y-directions configured to form a plane generally parallel to said spine and a surface of said chest of said wearer, said breasts extending from said surface of said chest of said wearer in said Z-direction, said binder (100) comprising:

a. a front panel (120) comprising a single ply of a first woven textile;

b. a rear panel (130) connectively engaged to said front panel (120) to form a garment, said rear panel (130) comprising a single ply of a second woven textile, said garment encircling said torso and overwrapping said breasts of said wearer;

c. first and second shoulder straps (180) each of said shoulder straps (180) being connectively engaged at a first end to said front panel (120) and at a second end to said rear panel (130), said shoulder straps (180) defining a region therebetween for insertion of said head;

d. a closure device (220) disposed intermediate said front panel (120) and said rear panel (130), wherein said closure device (220) connectively engages an edge (230) of said front panel (120) and an edge (230) of said rear panel (130); and, e. wherein said front panel (120) is configured to compress said breasts of said wearer toward said surface of said chest of said wearer in said Z-direction.

17. The binder of claim 16 wherein said first textile forming said front panel (120) and said second textile forming said rear panel (130) each have a percent stretch value of at least about 45% in said Y-direction and a percent stretch value of at least about 5% in said X-direction as measured in accordance with ASTM 2594.

18. The binder of claim 16 wherein said single ply of a woven textile forming said front panel (120) stretches in at least one of said X- and Y-directions, said stretching in at least one of said X- and Y-directions being configured to compress said breasts of said wearer toward said surface of said chest of said wearer in said Z-direction.

19. The binder of claim 16 wherein said front panel (120) further comprises a second ply of said first woven textile bonded to said first ply of said first woven textile.

20. The binder of claim 16 wherein first woven textile forming said front panel 120 and said second woven textile forming said rear panel 130 each have a water vapor permeability of greater than about 50 as measured according to standard test method BS 7209.

* * * * *